United States Patent [19]

Bicskei

[11] 4,227,349

[45] * Oct. 14, 1980

[54] PRECISION BLOCKING OF LENS BLANK

[76] Inventor: Bela J. Bicskei, 7 Hememway Rd., Framingham, Mass. 01701

[ * ] Notice: The portion of the term of this patent subsequent to Feb. 6, 1996, has been disclaimed.

[21] Appl. No.: 956,244

[22] Filed: Oct. 31, 1978

Related U.S. Application Data

[63] Continuation-in-part of Ser. No. 893,078, Apr. 3, 1978.

[51] Int. Cl.[3] ..... B24B 1/00

[52] U.S. Cl. ..... 51/284 E; 51/277; 33/174 A

[58] Field of Search ..... 51/277, 284 R, 284 E; 33/174 A

[56] References Cited

U.S. PATENT DOCUMENTS

| | | | |
|---|---|---|---|
| 2,712,180 | 7/1955 | Lueck | 33/174 A |
| 3,049,766 | 8/1962 | Buckminster | 51/277 |
| 3,368,285 | 2/1968 | Buckminster | 33/174 A |
| 3,451,177 | 6/1969 | Buckminster | 51/277 |
| 3,507,076 | 4/1970 | Rudd | 51/277 |
| 3,861,089 | 1/1975 | England | 51/284 |
| 4,077,722 | 3/1978 | Bicskie | 33/174 A |
| 4,138,085 | 2/1979 | Bicskie | 51/277 |

*Primary Examiner*—Gary L. Smith
*Attorney, Agent, or Firm*—GeorgeE. Kersey

[57] ABSTRACT

Method and apparatus for the precision blocking of lens blanks by the adjustment of each such blank until it occupies a prescribed position where an alloy hub or "block" is removably affixed to the blank so that it can be properly gripped for finishing.

5 Claims, 6 Drawing Figures

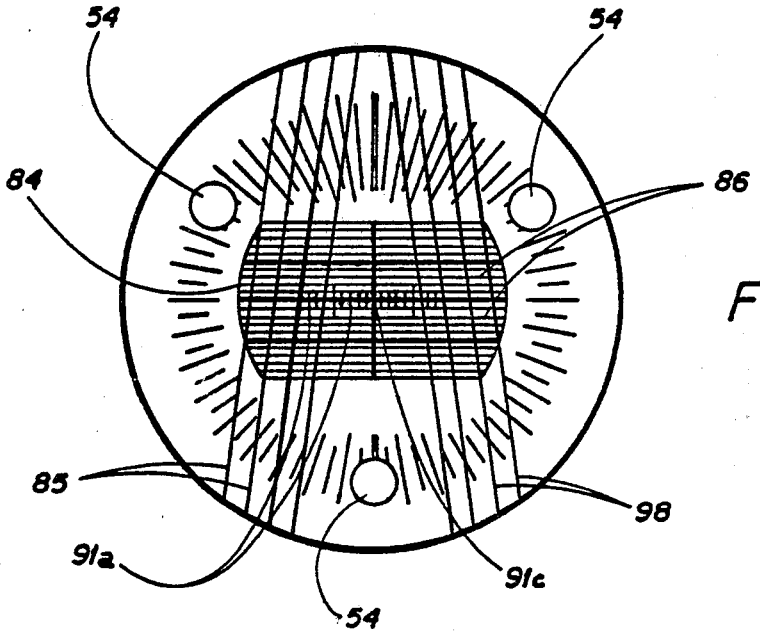
FIG. 2A
FIG. 2B
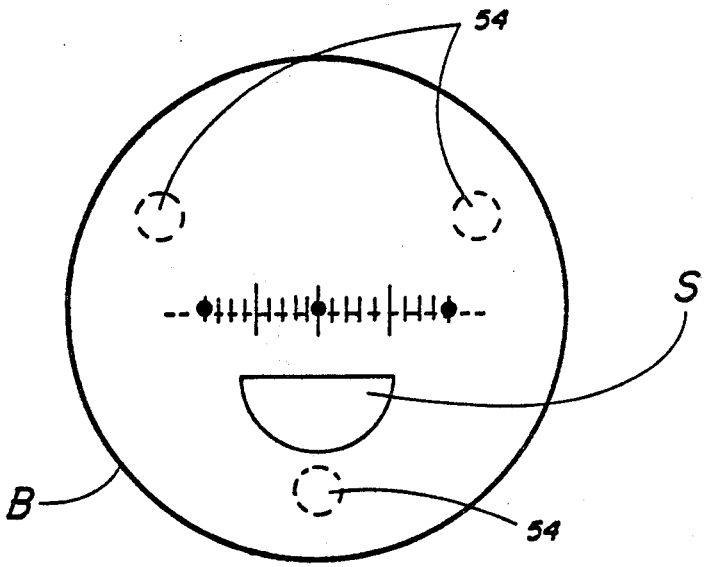

PRECISION BLOCKING OF LENS BLANK

BACKGROUND OF THE INVENTION

This is a continuation-in-part of Ser. No. 893,078, filed Apr. 3, 1978.

The invention relates to the blocking of lens blanks, and more particularly, to the precision attachment of blocks to lens blanks with multi-focal segments to permit finishing of the blanks.

Lens blanks require further processing before they can be used. Such blanks often incorporate one or more special elements, such as bifocal segments. One side of the lens containing, for example, a bifocal segment, is ground, i.e., surfaced, in a prescribed fashion. The opposite side is in a roughened form just as it is received from the mold.

Before a lens blank with a bifocal segment can be used, the rough side must be surfaced in accordance with a prescription provided by an oculist or optometrist. This requires the placement of a temporary hub or block on the finished side of the blank so that it can be held by an appropriate tool for finishing the other side, as well as the edge of the blank.

In the usual procedure, the desired optical parameters are manually located and marked on the blank. A representative device for marking a lens blank is described in U.S. Pat. No. 2,917,971 which issued to L. W. Goddu, et al., on Dec. 22, 1959. Once the lens blank has been appropriately marked, it is then transferred to a special instrument or "blocker" where the hub or block is temporarily affixed. This procedure is cumbersome and inaccurate. It requires an operator with considerable skill, yet it typically produces tolerances which do not satisfy recognized standards. The consequence, for example, of improper location of the optical center of a multi-focal lens can be eye strain, headaches and other visual difficulties.

Accordingly, it is an object of the invention to increase the precision with which lens blanks can be processed, particularly lens blanks with special elements. A related object is to obtain increased precision in the processing of multi-focal lens blanks. Another related object is to achieve the precise blocking of lens blanks, particularly bifocal and multi-focal lens blanks.

Another object is to reduce the number of rejects encountered in the processing and blocking of lenses, especially multi-focal lenses. A companion object is to raise the level of accuracy of acceptable lens blanks.

A further object is to achieve the precision processing of lens blanks with only semi-skilled operators. A related object is to facilitate the finishing of semi-finished lens blanks, particularly those containing multi-focal segments.

SUMMARY OF THE INVENTION

In accomplishing the foregoing and related objects, the invention provides for the precision adjustment of lens blanks relative to a viewing instrument, followed by the precision placement of a block on the lens blank, without disturbing its adjustment on the viewing instrument.

The viewer provides two degrees of translational motion. This permits accurate adjustment of the lens blank until prescribed optical conditions have been satisfied. Thus a bifocal lens blank can be centered and then de-centered on a viewing instrument by a prescribed amount in accordance with a prescription of a particular user.

The accuracy of each optical condition established using the instrument is maintained while the block is being attached. This eliminates the need for auxiliary scales and the marking of the blanks. The blocking may take place by forming a block on the lens while in position on the viewing instrument or by using a pre-formed block in conjunction with an adhesive member. The block holds the blank for proper finishing of the lens blank.

As a result the required skill of the operator is significantly reduced and the quality of the final, finished product is considerably increased.

DESCRIPTION OF THE DRAWINGS

Other aspects of the invention will become apparent from the detailed description which follows taken in conjunction with the drawings in which:

FIG. 2A is a view of the device of FIG. 1A showing its target-supporting mechanism;

FIG. 2B is a fragmentary view showing a lens blank on the target-supporting mechanism of FIG. 2A;

DETAILED DESCRIPTION

Figure 1A:
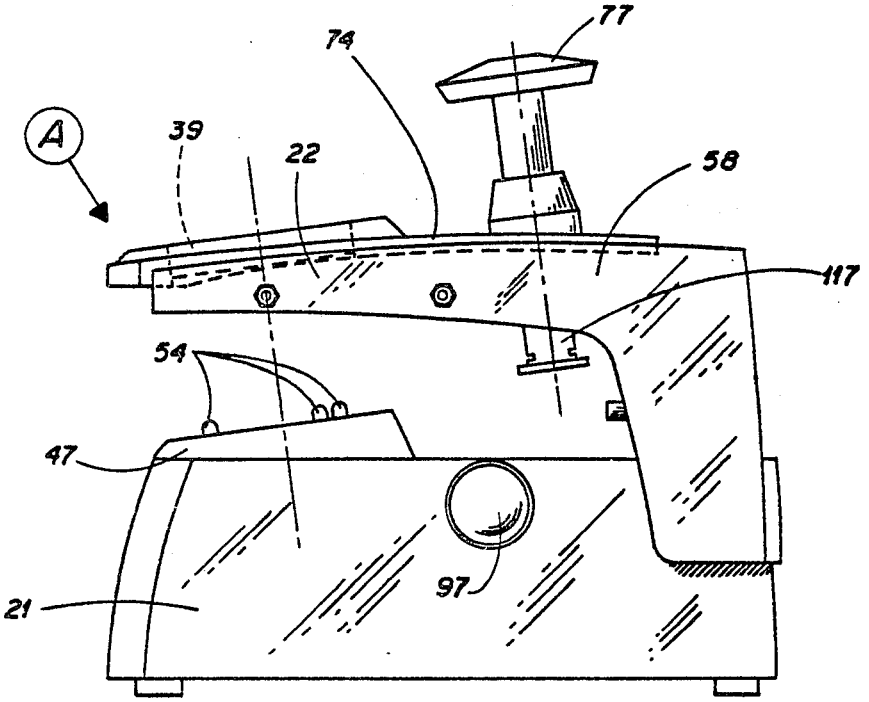
FIG. 1A is a front elevational view of one form of the device embodying the invention.
Figure 1B:
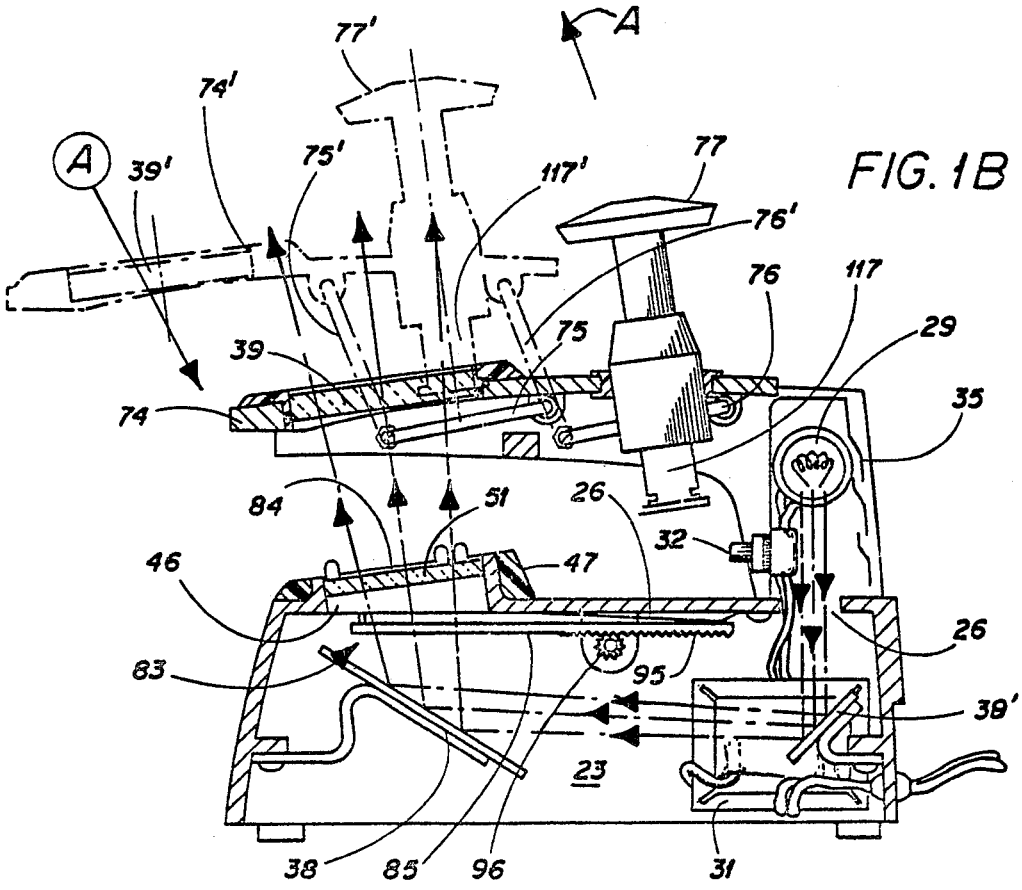
FIG. 1B is a side sectional view of the device of FIG. 1A.

With reference to the drawings, one form of device embodying the invention, as shown in FIGS. 1A and 1B is formed by a base 21 for supporting and viewing a lens blank and a head 22 mounted upon the base 21 for blocking the lens blank when positioned upon the base 21.

The base 21 is of any suitable material and is constructed with a hollow interior which is open at the bottom. The hollow interior is further divided into two chambers 23 and 24 by a wall 25 which is an integral part of the base 21 and has an opening 26.

A point source of light or lamp 29 is supported upon one side of the cavity 24 by a socket and adapted to project a beam of light downwardly through the opening 26 in the base 21 as described below. Beneath the light source 29 is a transformer 31 electrically connected to the lamp 29 to control the amount of current passing to the lamp. The transformer is, in turn, electrically connected through an on-and-off switch 32 mounted on one side of the cavity 24, to a source of current carried by an electrical conductor (not shown).

The back of the cavity 24 is provided with a cover plate 35 with louvered openings to allow the evacuation of heated air within the cavity 24 caused by the lamp 29.

The chamber 23 within the base 21 has a pivotally mounted mirror 38 and 39 which are used to view the combined images of a bifocal lens segment and target for aligning the segment image. The images of the lens segment and targets are viewed through a window opening 39 in the front of the wall 22.

A circular opening 46 is provided in the top of the base 21 and is positioned over and in vertical alignment with the center of the mirror 38. A circular supporting member 47 is secured directly over the opening 46. The supporting member 47 is further provided with a circular opening aligned with the opening 46 and has a ground glass viewing screen 51. The screen 51 is provided with an upstanding pins 55 having rounded or spherically formed tops adapted to be engaged by a lens blank when the lens blank is positioned thereupon for alignment.

The head 22 of the device is composed of two sections including a supporting arms 58 which are intimately fitted to the base 21.

The second member of the head 22 is a pivotally mounted support 74 which is held the arms 58 by pivot arms 75 and 76. The support is pivoted by lifting the knob 77 in the direction indicated by the arrow A. This causes the support to move to the phantom position 74', with the arms in phantom positions 75' and 75'.

Referring again to FIGS. 1B in conjunction with FIGS. 2A and 2B, a target assembly 83 is broadly formed by a stationary target 84 and a movable target 85. The stationary target 84 has a series of transversely extending clear cut lines 86 painted, etched or otherwise provided upon a circular sheet of suitable transparent material such as glass or plastic and are so spaced as to provide a one millimeter distance between the image of each of the lines 86.

It will be noted that the spacing of the lines 86 need not be restricted to one millimeter although the millimeter scale has become common practice in the optical trade.

The movable target 85 is formed by a transparent sheet of glass, plastic or the like upon which is painted, etched, or otherwise provided forwardly diverging or V-shaped guidelines 98, which are used to center the segment portion of a bifocal lens blank prior to the blocking of the lens blank.

The longitudinal movement of the target 85, by the knob 97 is to allow the operator to position the V-shaped guide lines 98 into bisecting relation with the outer boundaries of the segment, when the segment is moved into decentered position, thus being able to compensate for different size segments.

It is to be noted that the stationary target 84 is used with the movable target 85 to allow a bifocal lens blank B (FIG. 2B) to be aligned and thereafter blocked.

It is also to be noted that the light source 29 is substantially a point source which emits diverging rays. Since it is desirable to have light rays nearly parallel to each other, at the points where they pass through the targets 85 and 84 and lens blank B (FIG. 2B), the mirrors 38 and 39 are positioned to compactly form a relatively long path of light between the source 29 and the ground glass screen 51, causing the rays of light to be substantially parallel at targets 84 and 85 and lens blank B.

Since the light rays are not exactly parallel when passing through the targets 84 and 85 to the surface of the lens blank B, it is desirable to compensate for the slight diverging effect which will occur and cause the spacings between the images of the target lines projected on the lens blank to be slightly enlarged. In order that the images of the target lines 86 of target 84 be spaced on the lens blank B, a desired increment of measurement, such as one millimeter, the actual target lines on the target are spaced slightly closer together by an amount sufficient to compensate for the divergence of the light rays so that when projected on the lens blank, they will be spaced the desired distance apart. The distance between the targets and the lens blank and the angle of the light rays are the controlling factors in determining the spacing of the lines 86 of the target 84.

The difference in curvatures and index of refraction of the segment portion S with respect to the major portion of the lens blank B, because the light is substantially parallel, creates a discrete optical boundary which is shadowed by the point source illumination system and thus causes an image of the outline of the segment portion S to appear simultaneously with the images of the targets and onto the screen 51.

Since the distance between the lens blank B and the ground glass screen 51 is relatively short as compared to the distance from the targets to the light source 29 and the angle of divergence of the light rays is very slight at the targets and lens blank B, the combined images of the targets and the outline of the segment portion S as viewed upon the screen 51 are seen as distinct clean-cut lines which are readily visible to the operator of the device.

The support 74 also carries a blocking device 117 (FIGS. 1B and 3A) which is urged upwardly and against the bottom of the support when not in a use position by a spring 123 provided within a tubular member 120 (FIG. 3A) having one end at a shouldered retainer 124.

Figure 3A:
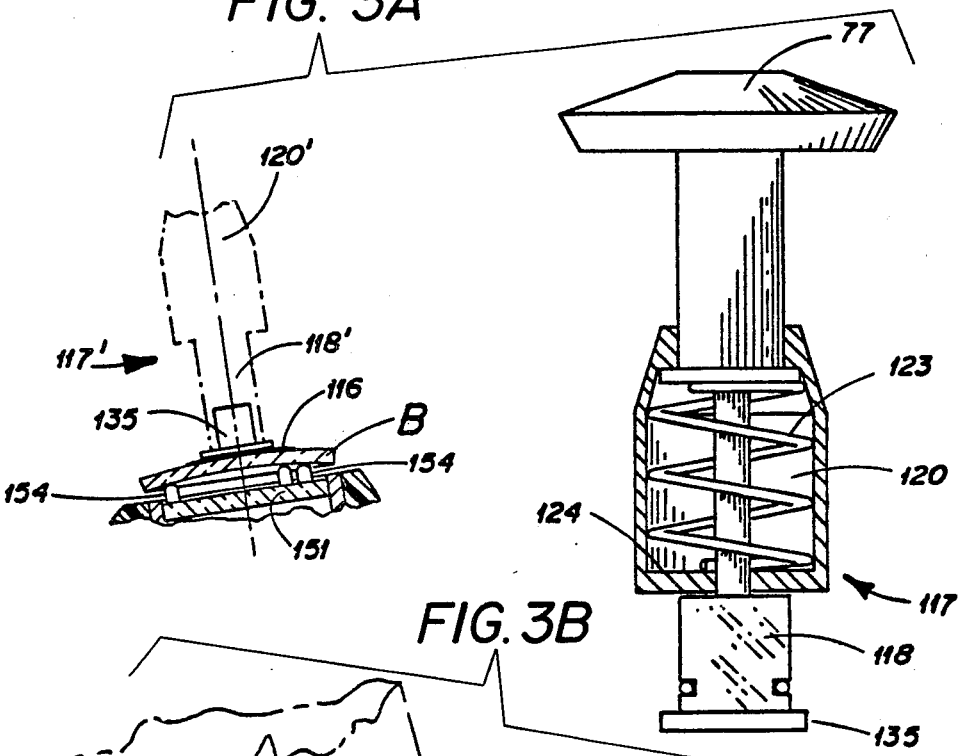
FIG. 3A is a fragmentary side view of one form of lens blocking mechanism used in the device of FIG. 1A.

Operation of the blocking device 117 is accomplished by downward movement of the handle 77 to cause the housing 118 of the blocking device 117 to be moved to the phantom position 118' in FIG. 3A.

Upon release of the handle 77 the blocking device 117 will again return to its initial position against the bottom surface of the member 74 due to the tension in the spring 123.

The housing 118 at the end of the blocking device 117 is provided with a recess 132 (FIG. 3B) which is adapted to carry a preformed block 135. The recess is proportioned to hold the preformed block 135, as shown in FIG. 3A. For that purpose a spring 133 in a groove **134*a* of the housing 118 engages the block 135 at an exposure slit 134*b* (FIG. 3B**).

Figure 3B:
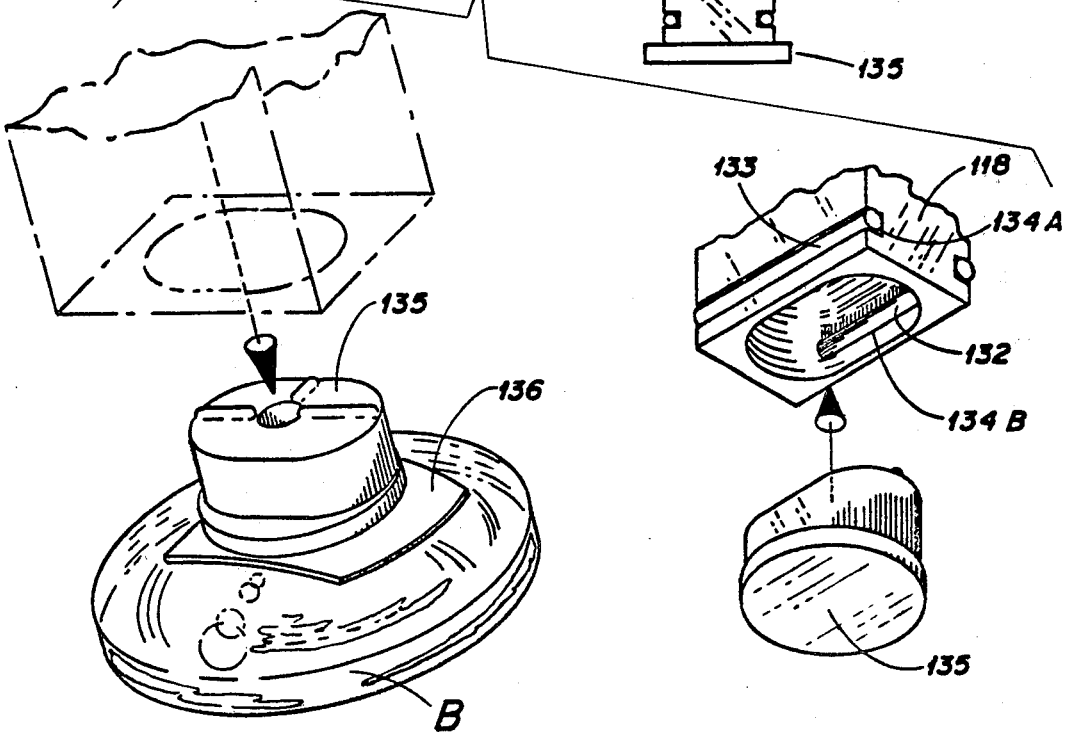
FIG. 3B is a fragmentary perspective view of the blocking mechanism of FIG. 3A.

When the support carrier 74 is positioned over the lens blank B in FIGS. 3A and 3B, and a double faced adhesive strip 136 is placed on the blank B, one surface of the strip 136 adheres to the blank B and the other surface adheres to the block 135. Consequently when the knob 77 is depressed the block 135 comes into engagement with the exposed adhesive surface and becomes adhered to the blank B. Accordingly, when the knob 77 is released, the block 135 is withdrawn from its nest in the carrier 118, and the desired blocking of the blank B has been achieved without the need for removing it from the instrument. It will be understood that the carrier 118 may be adapted to form an alloy block (not shown) on the blank B in place of the preformed block 135.

The operation of the device is summarized as follows:

When viewed from the side as in FIG. 1A the support 74 of the head 22 is initially seated within the arms 58 as shown in FIG. 1A.

A lens blank B, which is usually of the fused bifocal type with an optically finished convex surface is positioned upon the supporting pins 54 with the finished surface up as shown in FIG. 2B.

The light 29 is then turned on by operation of switch 33 causing an image of the targets 84 and 85 and a further image of the outline of the reading segment portion S of the lens to be simultaneously visible through the window 39.

The reading segment of the lens blank can then be decentered a prescribed distance either to the right or left of the optical center with respect to scale markings 91*a*. Markings to the right of center line 91*c* are used for decentering the segment portion of the lens blank to the right whereas the markings to the left of center line 91*c* are used to decenter to the left. The V-shaped lines 98 are then positioned using the knob 97.

After having set the device for the proper decentration, the operator next moves the lens blank B forwardly or rearwardly as necessary over the pins 54 to a point where the top of the outline of the segment portion image positioned over the image of a selected one of the target lines 86, which is selected according to the position desired of the top line of the segment below the optical center of the distance field of the finished lines. By doing so, the segment portion is positioned a prescribed distance below the optical center of the lens since the optical center due to the construction of the device is normally aligned with the uppermost of lines 86. The lens is now ready for blocking.

The support 74 in the head 22 of the device is then manually swung until it is over the blank B. The tape 136 is placed on the blank and the knob 77 depressed to secure the block 135 to the blank B.

While various aspects of the invention have been set forth by the drawings and specifications, it is to be understood that the foregoing detailed description is for illustration only and that various changes in parts, as well as the substitution of equivalent constituents for those shown and described may be made without departing from the spirit and scope of the invention as set forth in the appended claims.

What is claimed is:

1. The method of blocking a lens blank at a prescribed optical position comprising the steps of:

(a) adjusting a lens blank in an instrument until said lens blank satisfies a prescribed optical condition; and (b) pivoting a pivotable member of said instrument to said lens blank without disturbing the position of said lens blank; and (c) using a plunger mechanism of said pivotable member to bring a releasable block bearing a double-faced adhesive strip into contact with the lens blank to adhesively secure the block to the blank.

2. The method of claim 1 wherein said lens blank includes a bifocal setment:

said bifocal segment is centered on said instrument; and the adjustment is continued to decenter said bifocal segment by a prescribed amount.

3. The method of claim 1 wherein a block is affixed to said lens blank at the position where said member overlies said lens blank.

4. The method of claim 3 wherein said member is pivotally elevated and depressed to apply said block to said lens blank.

5. The method of claim 2 wherein said instrument includes support pins for said lens blank.

* * * * *